United States Patent [19]

Nakayama et al.

[11] Patent Number: 5,038,122

[45] Date of Patent: Aug. 6, 1991

[54] ELECTROMAGNETIC RELAY

[75] Inventors: Kiyofumi Nakayama, Sawa; Kazushige Kurihara, Ashikaga, both of Japan

[73] Assignee: Mitsuba Electric Mfg. Co. Ltd., Gunma, Japan

[21] Appl. No.: 482,168

[22] Filed: Feb. 20, 1990

[30] Foreign Application Priority Data

Feb. 23, 1989 [JP] Japan ..... 1-20686[U]

[51] Int. Cl.[5] ..... H01H 51/22

[52] U.S. Cl. ..... 335/78; 335/83; 335/202

[58] Field of Search ..... 335/78-85, 335/124, 128, 202

[56] References Cited

U.S. PATENT DOCUMENTS 4,498,065 2/1985 Nagamoto et al. ..... 335/79
4,827,232 5/1989 Minks ..... 335/128
4,837,538 6/1989 Pittmann ..... 335/202

*Primary Examiner*—Leo P. Picard
*Assistant Examiner*—Lincoln Donovan
*Attorney, Agent, or Firm*—Rodman & Rodman

[57] ABSTRACT

An electromagnetic relay wherein a movable contact is closed or opened against a stationary contact through excitation or demagnetization of an electromagnetic coil. A base made of synthetic resin and having a flat plate shape is provided with a space extending vertically. A stationary contact member is formed separately of a terminal member, the stationary contact member and the terminal member are provided on the side of a top surface and on the side of an undersurface of a base, respectively, and these members are connected to each other through a hole formed in the base. A recess for positioning the stationary contact member is formed on the top surface of the base. The movable contact is placed on a shorter side of the electromagnetic coil.

8 Claims, 5 Drawing Sheets

ELECTROMAGNETIC RELAY

BACKGROUND OF THE INVENTION

1. Field of the Invention

This invention relates to an electromagnetic relay, and more particularly to an electromagnetic relay suitable for controlling an electric circuit through closing or opening a contact.

2. Related Art Statement

The conventional electromagnetic relay of the type described comprises: a base made of synthetic resin and formed generally in a flat plate; a bobbin, at opposite ends of a spool of which flanges are projectingly provided; an electromagnetic coil wound around the spool; an iron core inserted through a tubular hole of the spool; yokes connected to opposite sides of the iron core and fixed to the base; a movable contact member for closing or opening a contact through excitation or demagnetization of the coil and rotatably supported about one end thereof; and a cover for covering the outside of the bobbin.

Some of the electromagnetic relays of this type are each formed in the base thereof with a plurality of mounting holes for installing the electromagnetic relay on a body of a motor vehicle.

However, when this electromagnetic relay is installed on a portion of the vehicle body for use for example in a turn indicator light in the motor vehicle, errors in the dimensional tolerance act combinedly between the mounting holes in the base of the relay and the mounting holes in the vehicle body for installing the relay. Therefore, an unreasonable mounting force is applied thereto during the installation, so that the base made of synthetic resin may be deformed or damaged. When the base would be deformed, shifts would be caused between component parts installed on the base. Or coupling of the base and the cover would be loosened, thus the cover falling off the case.

Furthermore, when the electromagnetic relay is installed in an engine room of the motor vehicle, temperature in the engine room varys in a wide range, whereby the resinous base fixed at plurality portions to the vehicle body may be thermally deformed, thus affecting the electromagnetic relay.

SUMMARY OF THE INVENTION

It is an object of the present invention to provide an electromagnetic relay capable of securing reliable installation, with a resinous base being prevented from being deformed or damaged.

It is another object of the present invention to provide an electromagnetic relay wherein positioning accuracy of a stationary contact member is high, so that mutual contact between the stationary contact member and a movable contact member can be reliably effected.

It is a further object of the present invention to provide an electromagnetic relay, wherein the stationary contact member can be easily produced.

The electromagnetic relay according to the present invention comprises: a base made of synthetic resin and formed generally in a flat plate; a bobbin, at opposite ends of a spool of which flanges are projectingly provided; an electromagnetic coil wound around the spool; an iron core inserted through a tubular hole of the spool; yokes connected to opposite sides of the iron core and held by the base; a movable contact member for closing or opening a contact through excitation or demagnetization of the coil and rotatably supported about one end thereof; a cover for covering the outside of the bobbin; a largely opened space extending through the base in the vertical direction; a plurality of fixing portions respectively, inwardly projected from inner peripheral walls of the space; a first terminal member having a couple-in portion being similar in a planar shape to the above-described space; and a stay supporting one end portion of the movable contact member and fixed to the yoke. The couple-in portion of the first terminal member is coupled into the above-described space so as to abut against the fixing portions on the side opposite to the yokes. A support portion of the yoke and a support portion of the stay are respectively inserted through fixing holes formed in opposite end portions of the couple-in portion of the first terminal member. And then, the support portions which project from an end face of the couple-in portion of the first terminal member are clinched so that said couple in portion, the yokes and the stay fixed to the yoke combinedly clamp the fixing portions.

Furthermore, in the electromagnetic relay according to the present invention, a second terminal member may be formed separately of the stationary contact member. This stationary terminal member is provided with a stationary contact which is opposed to a movable contact on the side of top surface of the base. The second terminal member is provided on the undersurface of the base and a portion of the second terminal member is extended through a hole in the base and connected to the stationary contact member. The stationary contact member may be positioned in a positioning recess formed on the top surface of the base.

Furthermore, the stationary contact member may be formed integrally of the second terminal member, i.e may be formed as a lug forming a part of the second terminal member. In this case, the lug is extended through a hole of the base, and is projected from the top surface of the base. Then, the lug is twisted by 90° so that the stationary contact provided on the lug is opposed to the movable contact.

In the electromagnetic relay according to the present invention, the couple-in portion of the terminal member is coupled into the resinous base so as to abut against the fixing portions of the base 10. The yokes and the stay are clinched so that the terminal member and the yokes and the stay clamp the fixing portions of the base. Thus, the terminal member, the yoke and the stay are integrally fixed with one another and the resinous base being the flat-shaped and having the space largely opened therethrough is considerably improved in rigidity. In consequence, even if the stress is caused by the installing work or temperature change and the like in the environment of use, the base is not deformed.

Furthermore, the stationary contact member is formed separately of the second terminal member, whereby positioning of the stationary contact member can be made with high accuracy, so that alignment between the stationary contact member and the movable contact member can be made accurately. Moreover, in this construction, the stationary contact member can be easily produced and such a problem that spring-back action occurring due to the stress during the working can be avoided.

BRIEF DESCRIPTION OF THE DRAWINGS

The above and other objects and features of the present invention will become more apparent when referred to the following descriptions given in conjunction with the accompanying drawings, wherein like reference numerals denote like elements, and in which.

DETAILED DESCRIPTION OF THE PREFERRED EMBODIMENT

Figure 1:
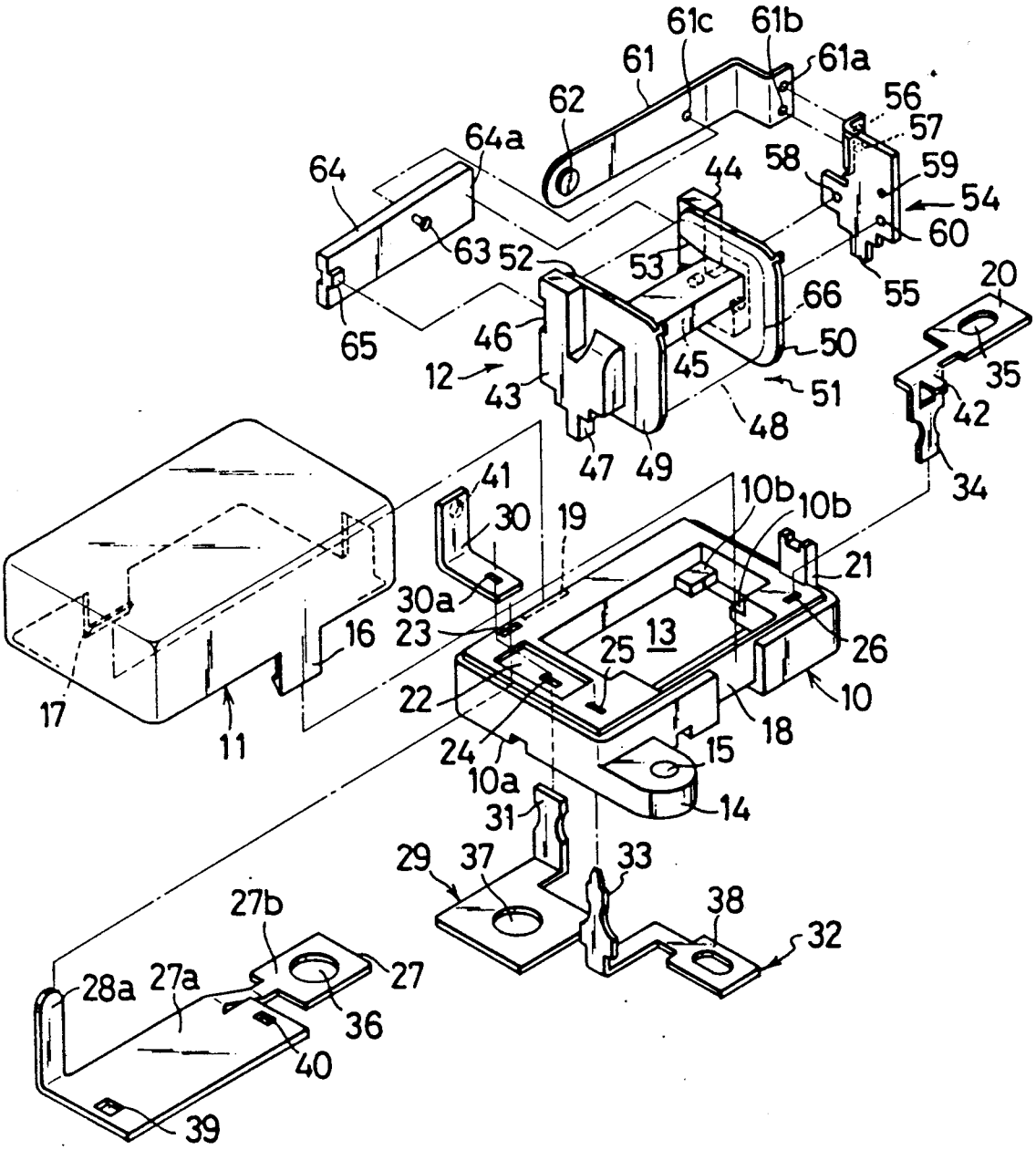
FIG. 1 is a disassembled perspective view showing one embodiment of the electromagnetic relay according to the present invention.
Figure 2:
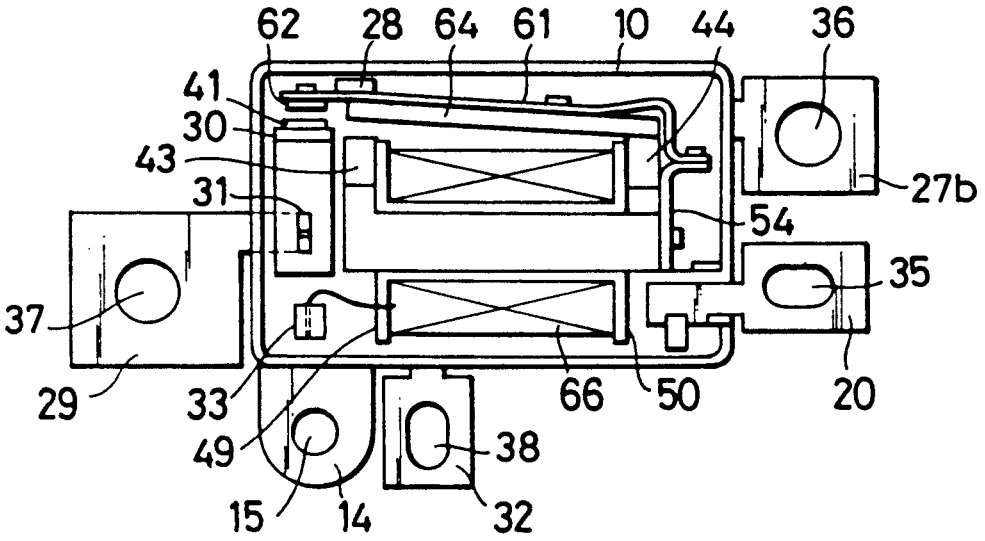
FIG. 2 is a plan view showing the assembled state thereof.
Figure 3:
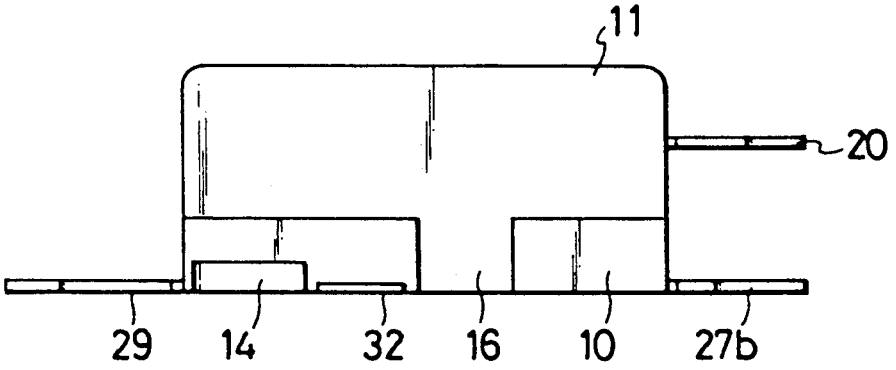
FIG. 3 is a frontal view thereof.
Figure 4:
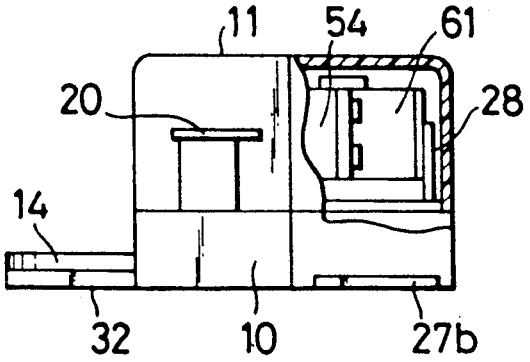
FIG. 4 is a side view thereof.
Figure 5:
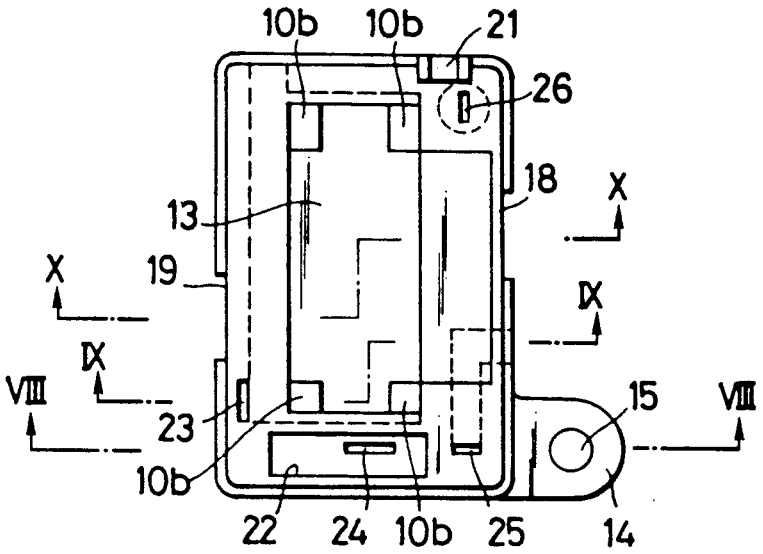
FIG. 5 is a plan view of the base.
Figure 6:
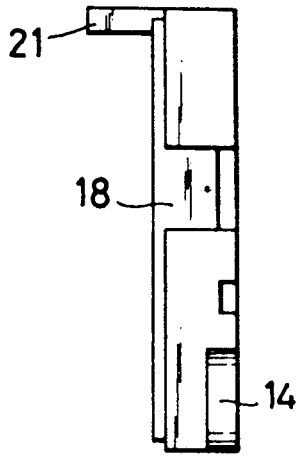
FIG. 6 is a side view of the base.
Figure 7:
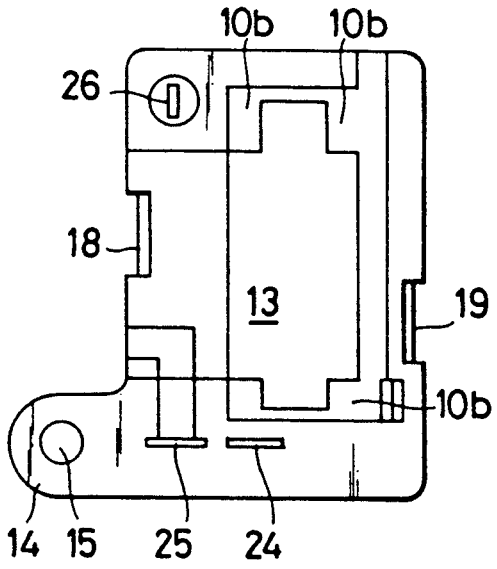
FIG. 7 is a bottom view of the base.
Figure 8:
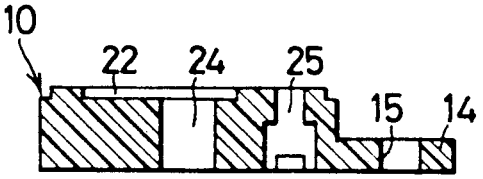
FIG. 8 is a sectional view taken along the line VIII—VIII in FIG. 5.
Figure 9:
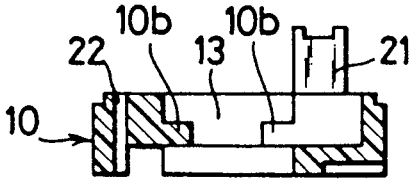
FIG. 9 is a sectional view taken along the line IX—IX in FIG. 5.
Figure 10:
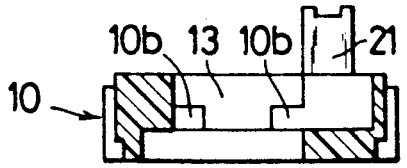
FIG. 10 is a sectional view taken along the line X—X in FIG. 5.

Referring now to the drawings, in the embodiment shown in FIGS. 1 through 10, the electromagnetic relay according to the present invention is provided thereon with a base 10 and a cover 11, both of which are made of synthetic resin having electric insulation properties and each formed integrally by itself. The base 10 is formed of a generally rectangular flat plate, and a space 13 for receiving a core 12 and the like is extended in the vertical direction to form a generally rectangular shape in the substantially central portion of a main surface (hereinafter referred to as a "top surface") of the base 10. Fixing portions 10*b* project inward from four corners on the inner peripheral surface of the space 13. A bracket 14 for installing this electromagnetic relay projects outward from an end portion of a side wall on a longer side of the base 10. The bracket 14 is formed therein with a mounting hole 15 for receiving a fastening member for the installation, not shown, in the thicknesswise direction. Further, grooves 18, 19 for receiving engaging pawls 16, 17 of the cover 11 are depressedly provided in the generally central portions of both of the side walls on the longer sides of the base 10, respectively, so as to extend in the thicknesswise directions of the both side walls. A projection 21 for supporting a terminal member 20 is provided uprightly at the top of one side walls on shorter sides of the base 10.

A recess 22 for positioning a stationary contact member to be described hereunder is depressedly provided in a rectangular shape with a predetermined depth in the neighbor of the shorter side near the bracket 14. A plurality of slots 23, 24, 25 and 26 are formed near the outer peripheral edge of the base 10, extending in a direction perpendicularly intersecting a fixing surface 10*a* of the base 10, i.e. in the vertical direction. The stationary contact member 30 formed into an angle shape has a bottom piece coupled into the recess 22 on the top surface of the base 10, whereby the contact member 30 is erected. The contact member 30 is fixed to the base 10 through a terminal member to be described hereunder.

A lug 28 of a first terminal member 27 to be described hereunder is inserted into the first slot 23, and a support portion 31 of a second terminal member 29 is inserted into the second slot 24. Furthermore, a lug 33 of a third terminal member 32 is inserted into the third slot 25, and a lug 34 of the fourth terminal member 20 is inserted into the fourth slot 26. After the lugs 33, 34 are inserted into the slots 25, 26, respectively, they are clinched and fixed to the base 10, respectively. Furthermore, the support portion 31 of the second terminal member 29 is inserted through the second slot 24, and simultaneously, inserted through a slot 30*a* of the stationary contact member 30 which has been coupled into the recess 22, and clinched, whereby the second terminal member 30 and the stationary contact member 30 are fastened together and fixed to the base 10.

The terminal members 20, 27, 29 and 32 are respectively formed with mounting-holes 35, 36, 37 and 38 for electric connection. A couple-in portion 27*a* having a rectangular shape somewhat smaller than the flat planar shape of the space 13 is formed in the first terminal member 27, and holes 39, 40 for fastening the terminal member 27 together with the core 12 and the like to the base 10 are formed at end portions of both shorter sides of this couple-in portion 27*a*. The first terminal member 27 is set such that the couple-in portion 27*a* thereof is inserted from below into the space 13, coupled thereinto, and abutted against the fixing portions 10*b*. At this time, a bracket 27*b* directed outward from the shorter side of the couple-in portion 27*a* of the first terminal member 27 and integrally projected from the couple-in portion 27*a* is projected in opposite to the shorter side near the bracket 14. This bracket 27*b* is formed therein with a mounting hole 36 for installing this electromagnetic relay.

A stationary contact 41 is outwardly projectingly provided at the forward end of the stationary contact member 30 and fixed thereto, and this stationary contact 41 is opposed to a movable contact 62 to be described hereunder. One end of a coil 66 is connected to the forward end of the lug 33 of the third terminal member 32, and the other end of the coil 66 is connected to a projection 42 of the fourth terminal member 20.

The core 12 has a pair of yokes 43, 44 and an iron core 45. Opposite ends of the iron core 45 are integrally formed on the central portions of the respective yokes 43, 44, whereby a H-shaped core 12 is formed is such a manner that plate member are punched into generally C shapes, and then, bent. A groove 46 is cuttingly provided on a side wall of the upper portion of the yoke 43, and a support portion 47 is vertically downwardly projected from the bottom end surface of the yoke 43. A support portion 47 of the yoke 43 is inserted into a fixing hole 39 formed in the couple-in portion 27*a* of the first terminal member 27 which has been coupled into the space 13 of the base 10, the forward end portion of the support portion 47 is clinched with a punch or the like and fixed to the terminal member 27. At this time, the yoke 43 is abutted against the two of the fixing portions of the base 10 from above and the couple-in portion 27*a* of the first terminal member 27 is abutted against these fixing portions 10*b* from below, whereby the yoke 43 and the couple-in portion 27*a* are brought into a state of clamping these fixing portions 10*b*, so that, when the support portion 47 is clinched to the fixing hole 39, the yoke 43 and the first terminal member 27 can be fixed to the base 10 relatively with each other.

The iron core 45 is formed into a generally rectangular shape in section, and a shorter side thereof is perpendicularly intersecting a fixing surface 10*a* of the base 10. A spool 48 having a U-shaped section is mounted on the outer periphery of this iron core 45. Flanges 49, 50 each having a generally rectangular outer shape are integrally formed on opposite ends of the spool 48. The spool 48 and the flanges 49 and 50 constitute a coil bobbin 51. Shorter sides of the flanges 49, 50 are arranged in a direction perpendicular to the fixing surface 10*a* of the base 10, and cut-away portions 52, 53 are formed in shorter sides on one side of the flanges 49, 50. The iron core 45 is coupled into a tubular hole, not shown, of the spool 48 through these cut-away portions 52, 53 and an open position of the U-shaped spool 48.

A spring stay 54 is fixed to the other yoke 44 and erected on the base 10. A support portion 55 of the spring stay 54 is inserted into the fixing hole 40 of the couple-in portion 27*a* of the first terminal member 27, which has been coupled into the space of the base 10, and the forward end of the support portion 55 is clinched with a punch or the like and fixed to the terminal member 27. At this time, the yoke 44 is abutted against the two of the fixing portions 10*b* of the base 10 from above and the couple-in portion 27*a* of the first terminal member 27 is abutted against these fixing portions 10*b* from below, whereby the yoke 44 and the couple-in portion 27*a* are brought into a state of clamping these fixing portions 10*b*, so that, when the support portion 55 of the spring stay 54 is clinched to the fixing hole 40, the yoke and the first terminal member 27 can be fixed to the base 10 relatively with each other. This spring stay 54 is formed therein with a plurality of small holes 58, 59 and 60, and projections formed on a side wall of the yoke are inserted into the small holes 58, 59 and 60 and clinched thereto, so that the spring stay 54 can be connected to the yoke 44.

Further, the spring stay 54 is provided thereon with projections 56, 57 which have been struck out. After the projections 56, 57 are inserted into small holes 61*a*, 61*b* formed in a contact spring 61 as being a movable contact member, forward ends of the projections 56, 57 are clinched, so that the spring stay 54 and the contact spring 61 can be fixed to each other. A movable contact 62 is fixed to a forward end of the contact spring 61 which is disposed such that the movable contact 62 is opposed to the stationary contact 41 of the stationary contact member 30. An armature 64 having a rectangular plate shape is abutted against this contact spring 61 to the side of the coil. A projection 63 which has been struck out of the armature 64 is inserted into a small hole 61*c* formed in the contact spring 61. And thereafter, a forward end of the projection 63 is clinched, so that the contact spring 61 and the armature 64 are fixed to each other. A projection 65 is expandedly provided at one end of this armature 64. When the armature 64 is fixed to the contact spring 61 and the contact spring 61 is fixed to the spring stay 54, one end 64*a* of the armature 64 is abutted against a side wall of the yoke 44, and the other end of the armature 64 at the side of the projection 65 is arranged at a position close to a side wall of the yoke 43. Thus, the contact spring 61 is adapted to rock on a shorter side of a flat square prism of electromagnetic coil 66 wound around the outer surface of the spool 48.

Installation work and action of the electromagnetic relay having the above-described arrangement will hereunder be described.

When the above-described electromagnetic relay is to be installed on a vehicle body of a motor vehicle and the like, the bracket 14 of the base 10 is abutted against a position of installation, not shown, on the vehicle body of the motor vehicle and the like and the mounting hole 15 is aligned with a mounting hole, not shown, formed at the position of installation and the mounting holes are fastened through fastening members, not shown, such as a bolt, a nut and the like.

Subsequently, the mounting hole 36 of the bracket portion 27*b* of the first terminal member 27, the mounting hole 37 of the second terminal member 29, the mounting hole 38 of the third terminal member 32 and the mounting hole 35 of the fourth terminal member 20 are aligned with predetermined counterpart members, not shown, and fastened thereto respectively, so that the respective terminal members can be connected to the counterpart members electrically and mechanically.

In this state, the couple-in portion 27*a* of the first terminal member 27 is coupled into the space 13 of the base 10, and the support portion 47 and the yoke 43 and the support portion 55 of the spring stay 54 are clinched to the mounting holes 39, 40 of the couple-in portion 27*a*, whereby the first terminal member 27 becomes integral with the base 10 and the bracket portion 27*b* of the first terminal member 27 projects in a direction different from the bracket 14 of the base 10, so that the base 10, i.e. the electromagnetic relay is fixedly installed on the vehicle body of the motor vehicle and the like between the bracket 14 and the mounting hole 36 of the first terminal member 27.

The first terminal member 27, which is coupled into the base 10 and made of a metallic material having electric conductivity. The support portion 47 of the yoke 43 and the support portion 55 of the stay 54 are clinched in a state where the fixing portions 10*b* of the base 10 are clamped by the terminal member 27, the yokes 43, 44 and the stay 54. Thereby, the resinous base 10 is effectively reinforced by the terminal member 27 and the yokes 43 and 44. And, even if a dimensional error between the electromagnetic relay and the position of installation is encountered during the work of installation, with the result that an unreasonable force is applied to the base 10, the resinous base 10 can be prevented in advance from being deformed and damaged.

Furthermore, this structure is effective to prevent lowering of function due to the thermal deformation of the base 10 when this electromagnetic relay is installed in an environment where temperature changes in a wide range as in an engine room of the motor vehicle and the like.

When electric power is fed to the terminal members 20, 32 to excite the electromagnetic coil 66, the armature 64 is attracted toward the yoke 43 by the electromagnetic force of the electromagnetic coil 66, whereby the projection 65 is attracted into the groove 46, so that a magnetic closed circuit can be formed. As the armature 64 is attracted, the forward end of the contact spring 61 is rocked, whereby the movable contact 62 is pressed against the stationary contact 41, so that an electric circuit including the terminal member 27 and the terminal member 29 is formed.

On the other hand, when feed of power to the terminal members 20, 32 is stopped to demagnetize the electromagnetic coil 66, the movable contact 62 and the armature 64 are returned to the original positions through the resiliency of the contact spring 61 and the electric circuit including the terminal members 27, 29 is opened.

The following advantages can be obtained by the above embodiment.

(1) The couple-in portion 27*a* of the terminal member 27 is coupled into the space 13 of the resinous base 10 and the couple-in portion 27*a* is fixed to the base 10 through the clinched portion of the yoke 43 and the spring stay 54, whereby rigidity of the resinous base 10 is effectively reinforced by mechanical strengths of terminal member 27 and the yoke 43, so that the base 10 can be prevented from being deformed and damaged.

(2) Even if the base 10 is made large in wall thickness for coupling the terminal member 27 therein, this thickness does not affect the thickness of the electromagnetic relay, since the space 13 formed in the base 10 receives the core 12 and the like.

(3) The movable contact is provided by the side of one of the shorter sides of the electromagnetic coil 66, so that the electromagnetic coil can be rendered thin in shape.

(4) A span of the contact spring 61 can be made long, so that the degree of freedom in the design of the spring can be improved.

(5) The yoke 43, 44 and the iron core 45 are formed as the core 12 in such a manner that plate members are punched, bent and all of these members are formed integrally with one another, so that the number of parts and the number of man-hours for assembling can be decreased.

(6) The stationary contact member 30 is formed separately of the second terminal member 29, and the stationary contact member 30 is clinchedly connected to the support portion 31 of the second terminal member 29, which has been extended through the slot 24 of the base 10, whereby positioning accuracy of the stationary contact member 30 is improved, so that alignment between the stationary contact 41 of the stationary contact member 30 and the movable contact 62 can be made accurately and reliable. Particularly, the recess 22 for positioning the stationary contact member 30 is provided in the base 10 and the stationary contact member 30 is received in the recess 22, so that positioning of the stationary contact member 30 can be made more accurate and reliable. Further, the stationary contact member in this embodiment need not be twisted for alignment between the stationary contact 41 and the movable contact 62, whereby the stationary contact member 30 can be easily worked on, so that such a merit can be obtained that spring-back action does not occur in the material.

Figure 11:
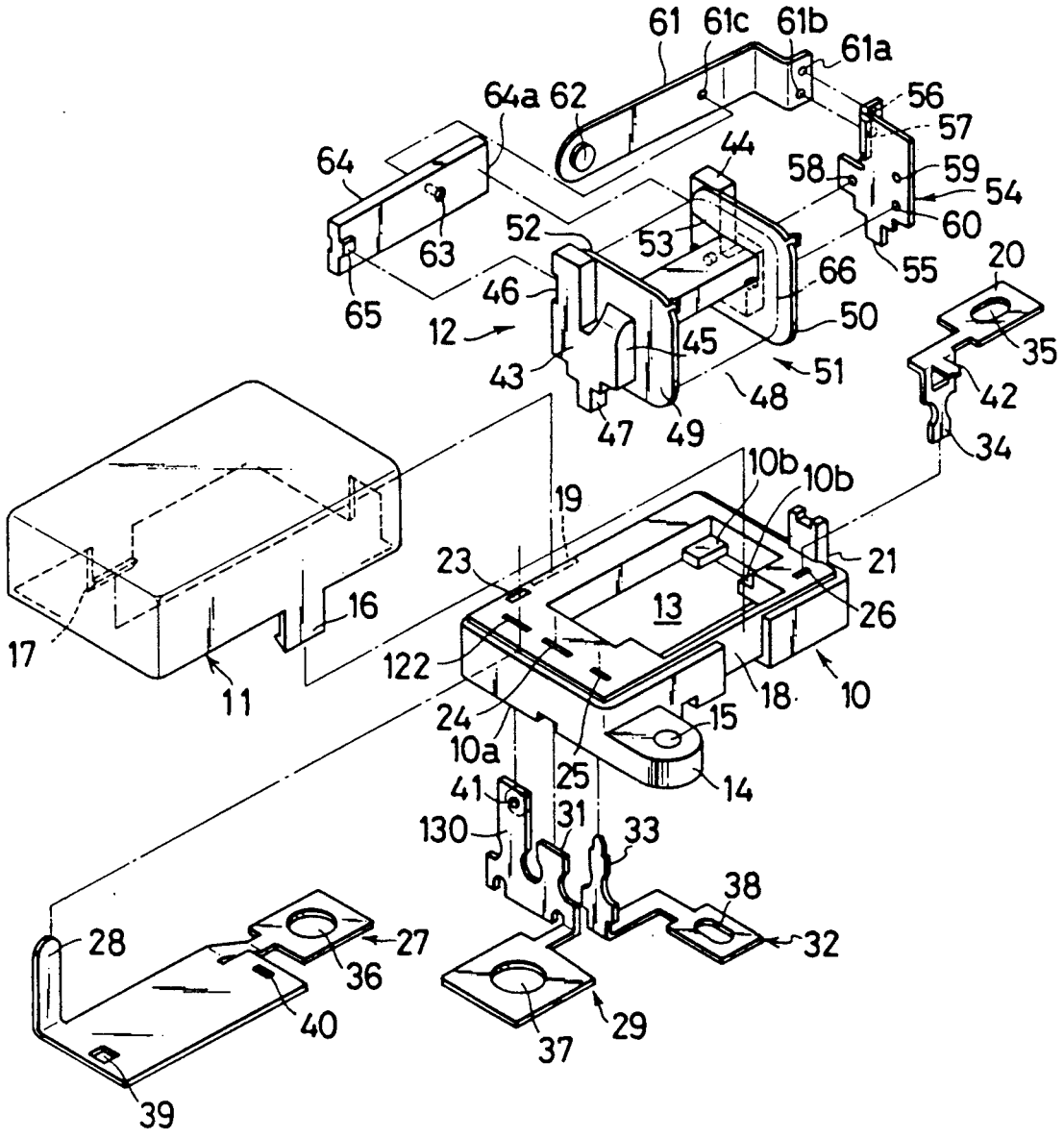
FIG. 11 is a disassembled perspective view showing another embodiment of the electromagnetic relay according to the present invention.
Figure 12:
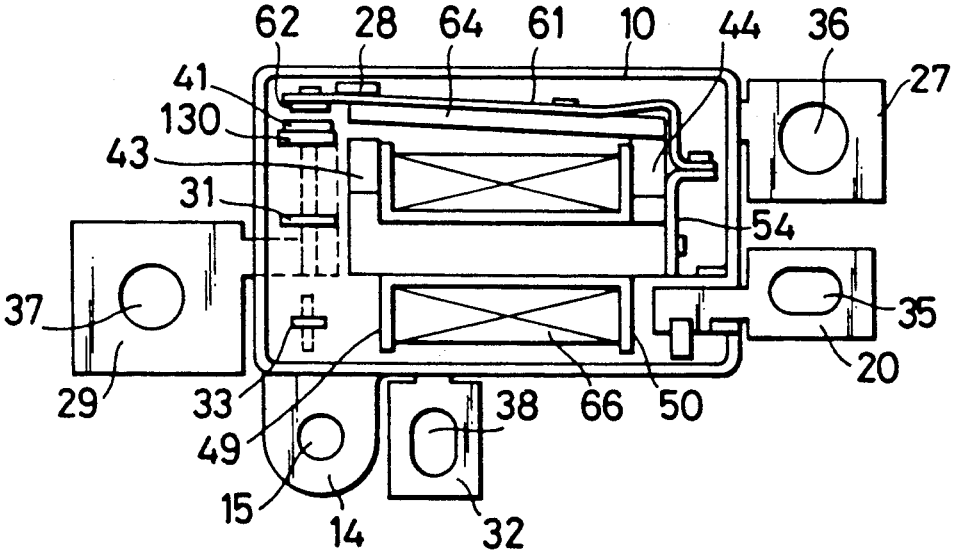
FIG. 12 is a plan view showing the assembled state thereof.

The second embodiment shown in FIGS. 11 and 12 is similar to the above-described embodiment shown in FIGS. 1 through 10, however, a main difference between the two embodiments resides in that the stationary contact member is formed integrally with the second terminal member, but not formed separately from each other.

Namely, in this embodiment, a stationary contact member 130 is integrally and projectingly provided as a lug at a position adjacent the lug 31 of the second terminal member 29. To insert this stationary contact member 130, a hole 122 is formed in the base 10.

During assembling, the stationary contact member 130 is inserted through the hole 122 of the base 10 and a forward end thereof is twisted by angle 90° so as to be fixed to the base 10. At this time, as is transferred from FIG. 11 to FIG. 12, the stationary contact member 130 is directed toward the movable contact 62, and the stationary contact 41 is fixed as opposed to the movable contact 62 so as to be aligned with the movable contact.

As has been described hereinabove, according to the present invention, the couple-in portion of the terminal member is coupled into the resinous base so as to abut against the fixing portions of the base, the yokes, the stay and the terminal member clamp the fixing portions of the base and are clinched, fixed and formed integrally with one another, so that the resinous base having the space largely extendingly formed in the flat plate shape is considerably improved in rigidity. In consequence, even if the stress during the work of installation of the electromagnetic relay and the thermal stress in the temperature change and the like in the environment of use of the electromagnetic relay act, the base is not deformed. As the result, positions of the component parts provided on the base are not shifted, so that reliable operations can be obtained. Moreover, the base is effectively reinforced by the utilization of the rigidity of the component parts such as the terminal members and the yokes, so that such an electromagnetic relay can be obtained that the increase in the number of parts and the like can be avoided and the resinous base can be prevented from being deformed.

Furthermore, the stationary contact member and the second terminal member are formed separately of each other, whereby the positioning accuracy of the stationary contact member can be improved, so that the stationary contact and the movable contact can be aligned with each other accurately and reliably. Moreover, in this case, the stationary contact member can be easily made and the occurrence of the spring-back phenomenon can be avoided.

Furthermore, the present invention is not limited to the above embodiment, and, needless to say that various modifications can be achieved within the scope of the present invention.

What is claimed is:

1. An electromagnetic relay comprising:

a base made of synthetic resin and formed generally in a flat plate shape;

a space extending through the base in the vertical direction, said space having a predetermined geometric shape and size;

a plurality of fixing portions on said base respectively inwardly projected from inner peripheral walls of the space and having opposite sides;

a bobbin supported on said base and including a spool with a tubular hole, said bobbin having opposite end portions provided with projecting flanges;

an electromagnetic coil wound around the spool;

an iron core inserted through the tubular hole of the spool, said iron core having opposite ends;

a pair of yokes connected to the opposite ends of the iron core, said yokes engaging one side of the fixing portions in the base;

a stationary contact member on said base, having a stationary contact;

a movable contact member on said base, having a stationary contact;

a movable contact member having one end portion pivotal with respect to said bobbin and having a movable contact engageable with the stationary contact for closing or opening the contact between the movable contact and the stationary contact through excitation or demagnetization of the coil;

a cover for covering the outside of the bobbin;

a first terminal member having a couple-in portion of similar size and shape with respect to said space, said couple-in portion being receivable in said space; and, a stay supporting said one end portion of the movable contact member, said stay being fixed to one of the yokes; wherein, the couple-in portion of the first terminal member is coupled into the space so as to abut against an opposite side of the fixing portions with respect to said yokes;

a support portion of one of the yokes and a support portion of the stay are respectively inserted through fixing holes formed in opposite end portions of the couple-in portion of the first terminal member, and the support portion of said one yoke and the support portion of the stay are clinched to the couple-in portion so that the couple-in portion of the first terminal member, the yokes and the stay fixed to said one of the yokes, clamp the fixing portions therebetween.

2. The electromagnetic relay as set forth in claim 1 wherein:

a second terminal member is provided on said base, said second terminal member being formed separately of said stationary contact member;

the stationary contact of said stationary contact member being opposed to the movable contact on a side of a top surface of the base; and, said second terminal member is positioned at an undersurface of the base, said base having a vertical hole and a portion of said second terminal member is extended through the vertical hole and connected to said stationary contact member.

3. The electromagnetic relay as set forth in claim 2, wherein a recess for receiving a portion of said stationary contact member to position the same is formed on the top surface of the base.

4. The electromagnetic relay as set forth in claim 1, wherein said yokes are formed by punching plates.

5. The electromagnetic relay as set forth in claim 1 wherein said electromagnetic coil has at least one long side and two shorter sides and said movable contact member is positioned along one of the shorter sides of said electromagnetic coil.

6. The electromagnetic relay as set forth in claim 4 wherein said yoke has a central portion and the opposite ends of said iron core are formed integrally with the central portion of said yoke so as to form a generally H-shaped core.

7. An electromagnetic relay comprising:

a base having a generally flat shape and a mounting surface;

a bobbin supported on said base and including a spool with a tubular hole, said bobbin having opposite end portions provided with projecting flanges having a predetermined outer periphery;

an electromagnetic coil wound around the spool;

an iron core inserted through the tubular hole of the spool, said iron core having opposite ends;

a pair of yokes connected to the opposite ends of the iron core, said yokes being fixed to the base;

a stationary contact member on the mounting surface of said base and having a stationary contact;

a movable contact member having one end portion pivotal with respect to said bobbin and having a movable contact engageable with the stationary contact for closing or opening the contact between the movable contact and the stationary contact through excitation or demagnetization of the coil;

a cover for covering the outside of the bobbin;

sections of the iron core and the tubular hole of the spool and the outer periphery of the flanges are formed to have a generally rectangular parallelepiped shape whose shorter side is included in a direction perpendicular to the mounting surface of the base;

said movable contact being pivoted to one of the shorter sides of the flange at one end of the spool; and, wherein the spool has opposite side surfaces along the shorter sides of said spool and the movable contact member is extended along one of the side surfaces of one of the shorter sides of the spool.

8. The electromagnetic relay as set forth in claim 7 including a terminal member secured to said base and wherein said stationary contact member is formed integrally with the terminal member as a portion thereof.

* * * * *